US007724198B2

(12) United States Patent
Axton et al.

(10) Patent No.: US 7,724,198 B2
(45) Date of Patent: May 25, 2010

(54) SYSTEM AND METHOD FOR PATH ALIGNMENT OF DIRECTIONAL ANTENNAS

(75) Inventors: Christopher Kipp Axton, San Antonio, TX (US); Dean Alan Erdman, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 804 days.

(21) Appl. No.: 11/609,553

(22) Filed: Dec. 12, 2006

(65) Prior Publication Data

US 2008/0297425 A1 Dec. 4, 2008

(51) Int. Cl.
*H01Q 3/00* (2006.01)

(52) U.S. Cl. ..... 343/757

(58) Field of Classification Search ..... 343/757, 343/761–763, 839–840; 455/65, 506
See application file for complete search history.

(56) References Cited

U.S. PATENT DOCUMENTS

| | | | | |
|---|---|---|---|---|
| 5,054,928 | A | 10/1991 | Egan et al. | 356/400 |
| 5,260,770 | A | 11/1993 | Nakamura et al. | 356/375 |
| 5,274,926 | A | 1/1994 | Dillon | |
| 5,600,436 | A | 2/1997 | Gudat | 356/141.3 |
| 5,760,739 | A | 6/1998 | Pauli | 342/359 |
| 5,760,909 | A | 6/1998 | Nichols | 356/4.08 |
| 5,982,481 | A | 11/1999 | Stone et al. | 356/152.2 |
| 6,356,239 | B1 * | 3/2002 | Carson | 343/765 |
| 6,462,718 | B1 | 10/2002 | Ehrenberg et al. | 343/880 |
| 6,466,175 | B1 | 10/2002 | Ehrenberg et al. | 343/761 |
| 6,466,179 | B1 * | 10/2002 | Ehrenberg et al. | 343/840 |
| 6,710,749 | B2 * | 3/2004 | King | 343/757 |
| 7,050,015 | B2 | 5/2006 | Bruchie | 343/840 |
| 7,091,922 | B2 | 8/2006 | Parsons et al. | 343/781 |
| 7,109,937 | B2 * | 9/2006 | Iluz et al. | 343/757 |
| 7,518,569 | B1 * | 4/2009 | Conrad | 343/882 |
| 2006/0003701 | A1 | 1/2006 | Daoud et al. | 455/65 |
| 2008/0143622 | A1 * | 6/2008 | Wu | 343/757 |
| 2009/0021447 | A1 * | 1/2009 | Austin et al. | 343/880 |

* cited by examiner

*Primary Examiner*—Huedung Mancuso
(74) *Attorney, Agent, or Firm*—Chowdhury & Georgakis PC

(57) ABSTRACT

A method and device for aligning an antenna to a desired heading. A laser beam is generated and aimed in a direction perpendicular to the desired heading. The line of sight of the laser is translated along the desired heading until the laser is directed to a reflective surface on the antenna's axis of transmission. The antenna is then positioned until the laser beam returns to a detector whose horizontal line of sight is the same as that of the laser, i.e., in a direction perpendicular to the desired heading.

12 Claims, 2 Drawing Sheets

SYSTEM AND METHOD FOR PATH ALIGNMENT OF DIRECTIONAL ANTENNAS

TECHNICAL FIELD OF THE INVENTION

This invention relates to radio frequency antennas, and more specifically to path alignment of directional antennas, such as tower-mounted parabolic antennas.

BACKGROUND OF THE INVENTION

In a microwave communications network, wherever a transmission path (link) is to exist, accurate antenna path alignment is required to insure proper communications. Typically, links are between tower-mounted antennas up to 25 miles apart, and an initial alignment process requires tower crews to physically align the antennas using sophisticated test equipment to monitor the results. Using today's techniques, initial alignment can be off-path by several degrees to either side of the target antenna, resulting in the target being in a null or side lobe of the pattern of the antenna being aimed.

More specifically, one current practice of initial alignment of tower-mounted antennas requires that the two antennas be installed on their towers to provide a signal link for power measurements. A compass bearing to the distant end is taken and the antenna is visually aimed at a ground-based reference along that direction, typically a marker or a natural reference such as a tree. Radios are installed at each site and used to optimize the path.

Some antenna alignment methods use out-of-network radio devices, which permit tower installation crews to perform the alignment process before network radios are installed. One example is the Path Align-R™ test set from XL Microwave. Two identical test sets are used, one at each tower site. Each test set drives its respective antenna directly, while receiving the signal from the other test set. During alignment, the test sets provide continuous duplex voice communication over the antenna link, allowing the two technicians to communicate with each other. Both units indicate the received path loss, and each antenna's azimuth and elevation is physically adjusted, until minimum loss (maximum alignment) has been reached.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

Figure 1:
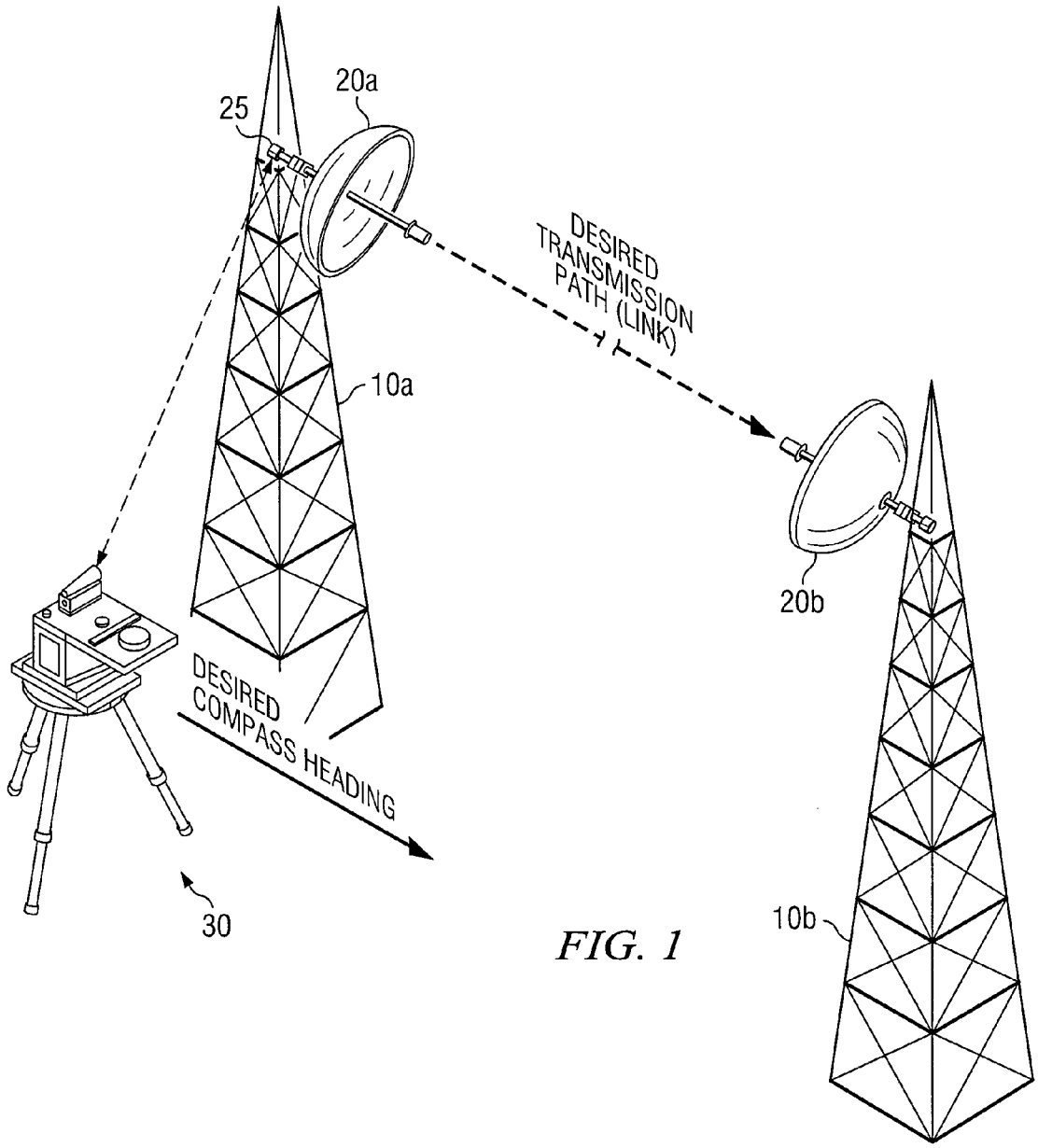
FIG. 1 illustrates two tower-mounted antennas, one being aligned to the other using a reflector and an alignment device in accordance with the invention.

FIG. 1 illustrates two antenna towers 10*a* and 10*b*, each having a tower-mounted antenna 20*a* and 20*b*, respectively. An alignment device 30 in accordance with the invention is shown being used for aligning the transmission path of antenna 20*a* to antenna 20*b*. It is assumed that the direction to antenna 20*b* is known, that is, its compass bearing.

Alignment device 30 is placed on the ground to the side of tower 10*a*, perpendicular to the desired transmission path. Typically, alignment device 30 is placed about 50 to 100 yards away from the tower base.

As explained below, antenna 20*a* has a special reflector 25 installed behind the antenna face. Aiming of antenna 10*a* is accomplished indirectly by using alignment device 30, which sends a laser beam to reflector 25, and receives the reflected beam when the position of antenna 20*a* provides a desired reflection path. The use of alignment device 30 facilitates and improves the accuracy of antenna alignment.

Although this description is in terms of parabolic tower-mounted antennas, the same concepts could be used to align any antenna, whether or not tower-mounted, whose transmission path is to be directed along a desired direction. With appropriate elevational adjustments, the alignment system and method described herein could be used to aim an antenna at a satellite.

In general, various types of directional antennas could require path alignment between fixed sites, mobile sites, or a mixture of fixed and mobile sites (referred to herein as "antenna sites"). Parabolic antennas have a relatively narrow focus (and high gain) as compared to other directional antennas, such as yagi and patch antennas, and are thus more susceptible to misalignment.

Figure 2:
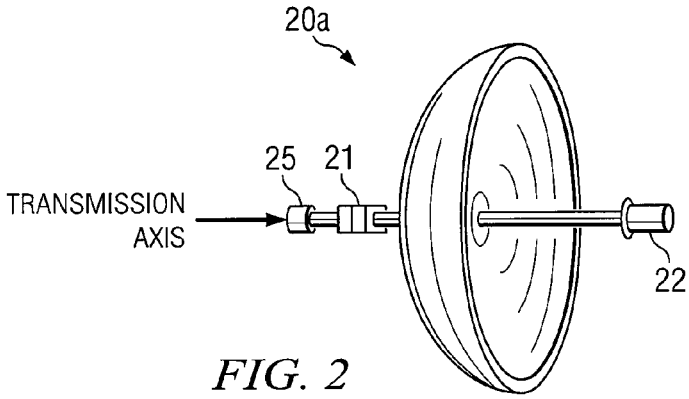
FIG. 2 illustrates a parabolic antenna having a reflector installed in accordance with the invention.

FIG. 2 illustrates antenna 20*a* in further detail. A feature of the invention is the installation of a reflector 25, which has a circumferential reflecting surface. As explained below, the curved reflecting surface ensures a reflection to the alignment device 30, which is not necessarily at the same elevation as the reflector 25. In some embodiments, reflector 25 could be implemented as a semicircular surface or as having some other surface curvature that is less than fully round, so long as it is capable of reflecting back to alignment device 30 without undue repositioning.

In the example of FIG. 2, reflector 25 is attached to the waveguide flange 21 input to the feedhorn 22. In general, reflector 25 is attached at some point on the antenna's transmission axis. In the case of a parabolic antenna, reflector 25 is behind the centerpoint of the antenna's reflecting surface. This is convenient in the case of parabolic antennas, because the reflector 25 can be easily attached for alignment and then removed prior to installation of antenna cabling.

Figure 3:
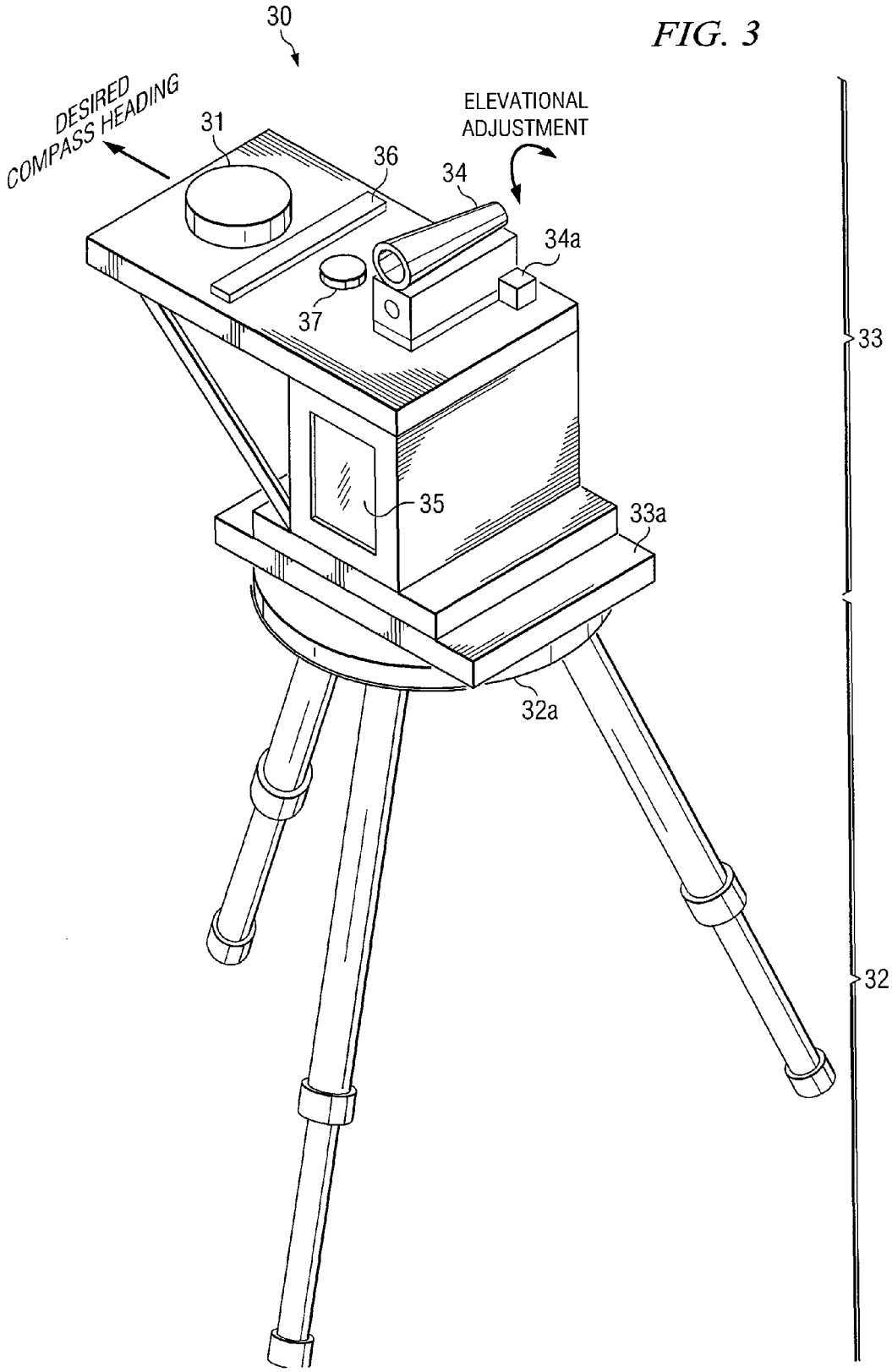
FIG. 3 illustrates an antenna aligning device in accordance with the invention.

FIG. 3 illustrates alignment device 30 in further detail. Alignment device 30 comprises an instrument unit 33 mounted atop a tripod 32. Instrument unit 33 comprises a magnetic compass 31, angular heading display 36, and a telescopic scope/laser unit 34, (referred to herein as the "optical unit" 33), all mounted atop a tripod 32. The scope and a detector 35 are positioned to receive a laser beam reflected from reflector 25.

Compass 31 is maintained in the desired heading of the signal path. The optical unit 34 and detector 35 have a common line of sight, and as explained below, this line of sight is perpendicular to the desired heading. During the alignment process, the line of sight is directed toward the reflector 25 on antenna 20*a*. An elevation adjuster 34*a* permits the elevation angle of optical unit 34, and thus the elevational direction of the optical path (upward toward the antenna) to be adjusted.

Alignment device 30 is equipped with various adjustment mechanisms. For leveling tripod 32, its legs may be adjusted in length, using telescoping adjustment mechanisms such as are familiar with camera tripods. To conveniently accomplish leveling, a level 37 may be mounted on the surface of instrument unit 33.

For rotating instrument unit 33 relative to tripod 32 so that compass 31 is pointed along a desired direction, tripod 32 has a swivel platform 32*a*. Instrument unit 33 is mounted on a slide platform, which permits instrument unit 33 to translate back and forth relative to tripod 32 so that the line of sight of optical unit 34 is aimed at reflector 25. Once device 30 is placed in an approximately correct location for aligning a particular antenna, these rotational and translatable adjustment mechanisms permit minor repositioning of the compass bearing (azimuthally) and optical path (horizontally) to be made without repositioning the entire device 30.

In operation, detection of a laser beam, emitted from the laser of optical unit 34, and reflected from reflector 25 in the same vertical plane of the laser, indicates alignment of the antenna along the correct heading. The tripod 32 is leveled, and the instrument unit 33 is rotated, using swivel platform 32*a*, so the readout on display 36 matches the desired heading to the distant end. Using the scope of optical unit 34, elevated to point toward the antenna, the operator checks how far the unit is forward of or behind the reflector 25. If necessary, tripod 32 is relocated to be within a few inches of perpendicular relative to the reflector 25, and the unit is re-leveled and reset to the desired heading.

Looking through the scope, the operator translates instrument unit 33 forward or back on the tripod 32 (using the sliding motion of platform 33*a*) as needed to view the crosshairs of the scope against the reflecting surface of reflector 25. The laser, elevated together with the scope of optical unit 34, is activated to illuminate the reflector 25, and antenna 20*a* is moved until the laser beam returns to detector 35 and the scope. A visible light on instrument unit 34 or an audible tone can be used to indicate antenna alignment along the correct heading.

The above-described equipment and method for antenna alignment are expected to achieve alignment within one-half of a degree of the direction to the target antenna site, so the distant end is within the main lobe of the antenna pattern. Because terrestrial position and Earth's magnetic field are used to determine the direction to the target location, installation of a distant end antenna on tower 10*b* is not required. In fact, so long as the location and bearing of a desired target tower (the location of tower 10*b*) is known, tower 10*b* need not be actually installed.

Placing the direction finding equipment on the ground has two main advantages. Separation of the compass 31 from tower 10*a* avoids distortion of the Earth's magnetic field due to proximity of the tower's metal structure. Furthermore, hauling cumbersome equipment up the tower is unnecessary. Only the reflector 25 is required to be carried up and installed behind the antenna 20*a*.

The tripod and fixture for the direction finding equipment could be constructed from a rigid non-metallic material to prevent distortion of Earth's magnetic field near the compass 31. Alternatively, the compass could be elevated about 1 meter above the fixture on a non-metallic shaft to allow using a metal fixture and tripod.

The above-described concept is expected to achieve initial antenna alignment within one-half of a degree of the target and is based on the precision of geographic location and angular bearing between the two sites relative to true north. Using the described equipment, the antenna is aimed at the target location within the 3-dB beam width of the antenna main lobe. Confusing signal measurements due to nulls and sidelobes in the antenna pattern are avoided, improving safety and efficiency by reducing man-hours spent in hazardous conditions on a tower. With initial alignment on the antenna main lobe, final antenna alignment can then progress quickly. Because terrestrial position and Earth's magnetic field are used to determine the direction to the target location, installation of the distant end antenna or tower is not required. The reflector 25 is expected to be smaller and lighter than radio equipment currently used for antenna alignment, so carrying it up the tower and installing it on the antenna flange would be less cumbersome.

What is claimed is:

1. A device for aligning an antenna to a desired heading, the antenna having a reflective surface for reflecting light from a direction perpendicular to its axis of transmission, comprising:

a support stand;

an instrument unit;

wherein the instrument unit is operable to rotate and translate in motions relative to the support stand;

wherein the instrument unit comprises: a compass, an optical unit having a scope and a laser, and a laser detector;

wherein the optical unit and detector have the same line of sight in the horizontal direction; and wherein the optical unit has an elevation angle adjustment mechanism for varying the line of sight in the vertical direction toward the reflective surface;

wherein the line of sight of the optical unit and detector are perpendicular to the desired heading when the device is in use.

2. The device of claim 1, wherein the support stand is a tripod.

3. The device of claim 1, wherein the support stand is adjustable such that the instrument unit may be leveled relative to the ground.

4. The device of claim 1, wherein the instrument unit can rotate in a direction relative to the support stand by being mounted on a swivel platform.

5. The device of claim 1, wherein the instrument unit can translate in a direction relative to the support stand by being mounted on a translatable platform.

6. A method of aligning an antenna to a desired heading, comprising:

providing a curved reflective surface at a point on the antenna's axis of transmission;

generating a laser beam in a direction perpendicular to the desired heading;

aiming the laser beam at the reflective surface; and positioning the antenna such that the laser beam is reflected back to a detector having the same vertical line of sight as the laser.

7. The method of claim 6, wherein the antenna is a parabolic antenna having a rod behind the reflecting surface and on the transmission axis, to which the reflective surface is attached.

8. The method of claim 6, wherein the aiming step comprises translating the laser beam in a direction along the desired heading.

9. The method of claim 8, wherein the antenna is mounted on a tower and the aiming step further comprises changing the elevational angle of the laser beam.

10. The method of claim 6, wherein the step of providing a curved reflective surface is achieved by affixing a reflector.

11. The method of claim 10, wherein the reflector is removeably affixed.

12. The method of claim 6, wherein the curved reflective surface is a cylinder placed on the transmission axis.

* * * * *